US005570946A

United States Patent [19]

Chien

[11] Patent Number: 5,570,946

[45] Date of Patent: Nov. 5, 1996

[54] PROTECTIVE HEADWEAR INCLUDING SUPER-THIN LIGHTING

[76] Inventor: Tseng L. Chien, 8F, No. 29, Alley 73, Lin-Shen Street, Shi-Chi Town, Taipei, Hieng, Taiwan

[21] Appl. No.: 438,373

[22] Filed: May 10, 1995

[51] Int. Cl.[6] ..... F21L 15/14

[52] U.S. Cl. ..... 362/84; 362/106

[58] Field of Search ..... 362/84, 105, 106

[56] References Cited

U.S. PATENT DOCUMENTS

| | | | |
|---|---|---|---|
| 1,572,210 | 2/1926 | Kolibas . | |
| 3,153,745 | 10/1964 | Gurian et al. | 362/84 |
| 4,231,079 | 10/1980 | Heminover | 362/106 |
| 4,901,210 | 2/1990 | Hanabusa | 362/106 |
| 4,901,211 | 2/1990 | Shen | 362/106 |
| 5,111,366 | 5/1992 | Rife et al. | 362/31 |
| 5,231,703 | 8/1993 | Garneau | 2/425 |
| 5,245,517 | 9/1993 | Fenton | 362/84 |
| 5,327,587 | 7/1994 | Hurwitz | 2/422 |
| 5,426,792 | 6/1995 | Murasko | 362/105 |

*Primary Examiner*—Carroll B. Dority
*Attorney, Agent, or Firm*—Bacon & Thomas

[57] ABSTRACT

A protective headwear such as a helmet or hard hat includes a hard outer layer to which is attached a thin lighting element such as an electro-luminescent or photoluminescent element. The super-thin lighting element may be positioned inside the outer layer so as to be protected thereby, the outer layer being provided with an opening or window through which the lighting element is visible.

21 Claims, 8 Drawing Sheets

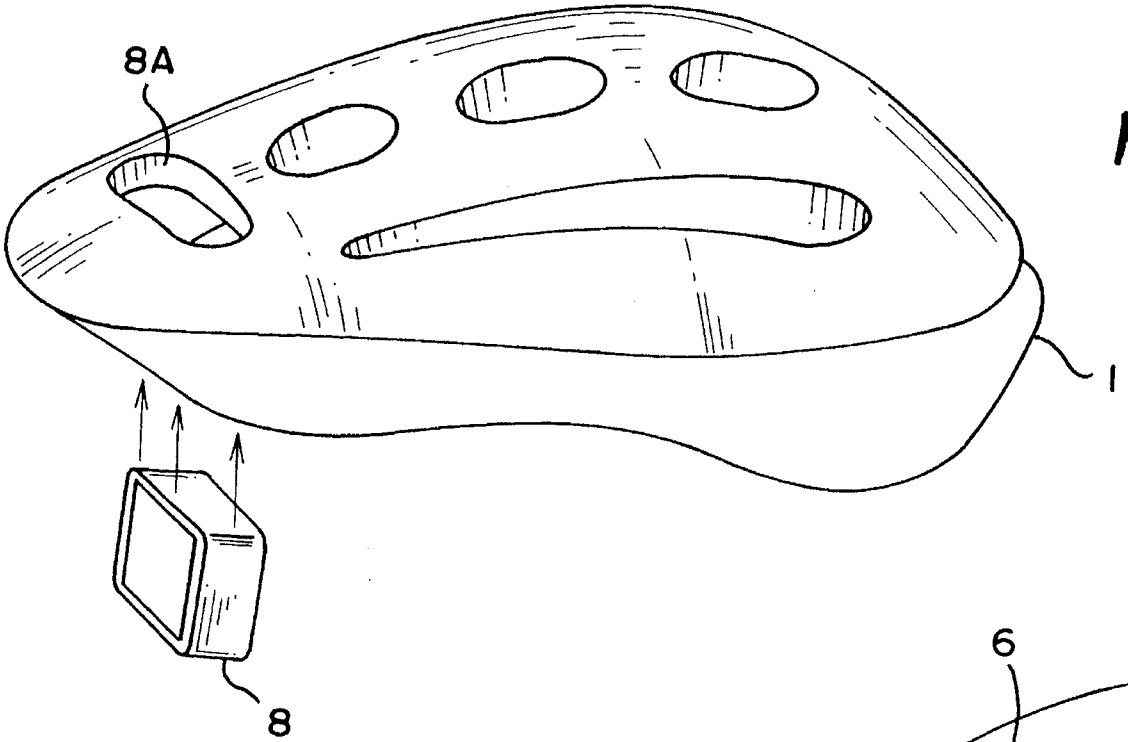
FIG. 4-A
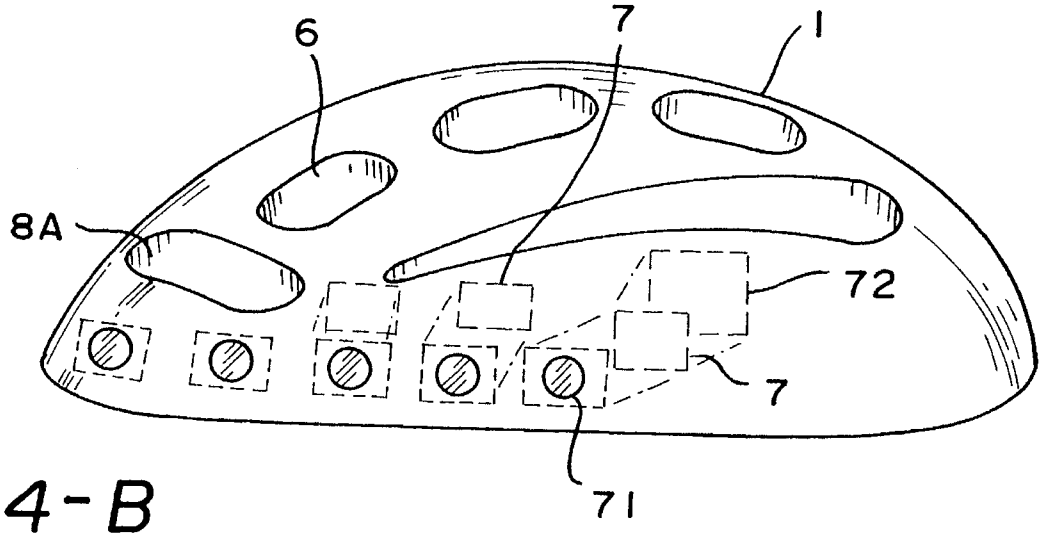
FIG. 4-B

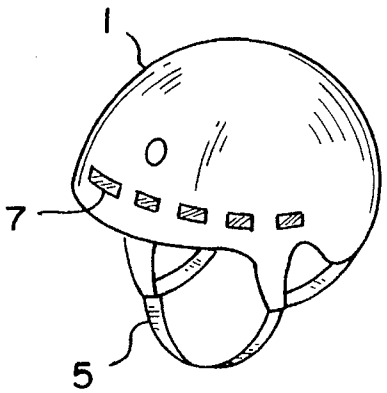
FIG. 9-D
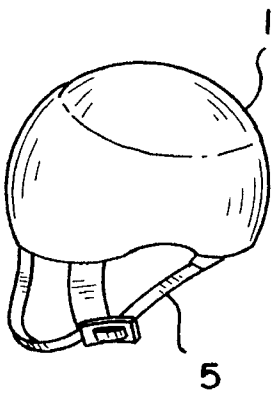
FIG. 9-C
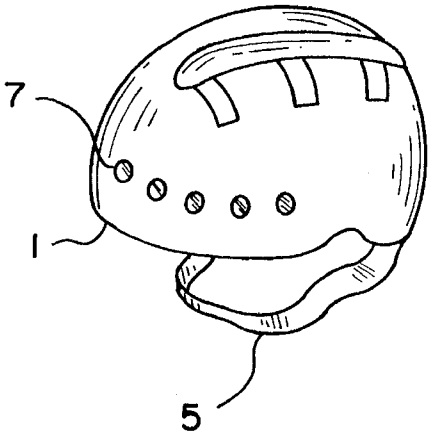
FIG. 9-B
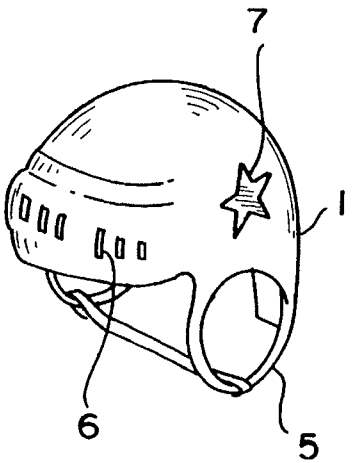
FIG. 9-A

PROTECTIVE HEADWEAR INCLUDING SUPER-THIN LIGHTING

BACKGROUND OF THE INVENTION

1. Field of the Invention

This invention relates to protective headwear of the type designed to protect the head of the wearer by deflecting, distributing, or absorbing forces which would otherwise cause injury, and in particular to protective headwear of the type which least includes a rigid outer layer, such as a helmet or hard hat, having attached thereto a super-thin lighting element in the form of an electro-luminescent (EL) or photo-luminescent (PL) strip or panel, for the purpose of increasing dark environment safety, as well as for advertising and promotional purposes. By "super-thin" is meant that the lighting element has a thickness of less than 10 mm, preferably less than 3 mm, and still more preferably on the order of one millimeter in thickness or less so as to be easily attached to any hard or soft curved surface.

2. Discussion of Related Art

The inclusion of lighting elements on protective headwear such as helmets or hard hats is known from a number of prior patents, and is also described in U.S. patent application Ser. No. 08/226,329, filed Apr. 12, 1994, now abandoned, and a continuation of the copending application, U.S. patent application Ser. No. 08/436,007, filed May 5, 1995.

The present invention provides improvements over each of the prior arrangements, either in terms of performance or safety. In many of the prior arrangements, accommodation for the lighting arrangement negates the protective effect of the headwear, and may in itself present a hazard. In others, the arrangement is simply too complicated or expensive for use in most protective headwear applications.

U.S. Pat. No. 4,231,079, for example, discloses an illumination arrangement for protective hat in which a plurality of LEDs are arranged in a single layer. However, the arrangement disclosed in this patent has the disadvantage that, in order to connect the LEDs to a power source located inside the hat, holes must be drilled into the hat, thereby compromising the integrity of the hat's construction, with potential weakening of the structure of the hat and therefore of the protection provided by the hat. In addition, the arrangement shown in this patent has a number of disadvantages common to all lighting arrangements involving LEDs, including a relatively narrow viewing angle, limited color choice, and relatively difficult assembly to the hat, particularly if area wide lighting is desired, such as might be the case if the lighting arrangement is used for advertising or promotional purposes. Still further, the LEDs, disclosed in this patent as being positioned in the hat and soldered to the electrical connections, present a hazard in themselves as they could possibly be pushed during a strong impact into the head of the wearer, which could cause a terrible brain injury.

Another example of illuminated protective headwear, in this case a motorcycle helmet, is disclosed in U.S. Pat. No. 4,901,210. Like the arrangement described in the Heminover patent, the arrangement described in this patent has the disadvantage that it requires drilling of holes into the helmet to provide a connection to a power source located inside the helmet, which could weaken the helmet structure, and in addition, the arrangement described in this patent utilizes a relatively bulky housing construction which is exposed to breakage during impacts against the helmet and therefore presents a potential injury hazard to the wearer, only partially mitigated by the fact that the illumination housing is placed at the rear of the helmet.

U.S. Pat. No. 5,111,366, on the other hand, discloses a soft cap having an area light which uses optical properties of a plastic panel to achieve a desired effect. As in the prior protective headwear arrangements, the use of LEDs described in this patent requires a complicated structure, costly assembly, and while the problem of narrow viewing angle is overcome by the optical panel, the LEDs provides only limited color choices.

Another prior disclosure of a lighting arrangement for headwear in general is found in U.S. Pat. No. 1,572,210. This patent also does not involve protective headwear, and the lighting arrangement described therein would in fact not be suitable for protective headwear because it involves placement of incandescent glass bulbs on a visor, and therefore a serious risk of injury to the face, head, and brain. In addition, the use of incandescent lighting has the disadvantage of requiring a relatively large power supply.

Similarly, U.S. Pat. No. 4,901,211 describes an illuminated visor structure using unspecified lighting means, but requiring a complicated housing structure which would be both impractical and hazardous to use in any type of headwear intended to serve a protective function.

On the other hand, U.S. Pat. No. 5,327,587 discloses an illuminated helmet which includes provision for an EL light strip mounted on an outside surface of the helmet, resulting in exposure of the light strip to damage from impacts and environmental influences.

Finally, British Patent Publication No. UK 0 166 534 describes an arrangement in which an EL light is housed within a transparent envelop which can be attached to a hat, but the EL light arrangement disclosed therein is impractical, particularly for use in protective headwear. Among the disadvantages of this arrangement is that the envelope would be very difficult to apply to a smooth surface such as a hard hat or helmet surface, and in addition the transparent envelop does not provide adequate protection for the EL material from ultra-violet radiation and from moisture.

As is apparent from the above description, the majority of prior art designs use incandescent bulbs or LEDs. In order to put even the smallest practical LEDs on a helmet, hard hat, or other protective headwear, the protective headwear must be provided with appropriate openings and/or indentations or the lighting elements will project from the surface of the hard hat (a minimum length for an LED is 10 mm, with a 3 mm diameter). Furthermore, because the maximum viewing angle of an LED is 45°, a large number of LEDs are required in order to obtain a large viewing angle. In addition, the electric wire connections between each LED require soldering at least two points, for the positive and negative connections, to the control circuit, necessitating additional labor and also a relatively large control circuit board, which means that the space required to mount an LED includes at least 10 mm of LED body length+1 mm thickness of printed circuit board+2 mm thickness for the soldering terminal, which totals 13 mm thickness for each LED. It is very difficult to mount such a fixture on the outside of the helmet, and the external fixture can, as noted above, itself present a hazard to the wearer because of the possibility that the lighting fixture will be pushed into the head of the wearer, as a result of which many countries have safety regulations prohibiting such installations on safety helmets or hard hats. The use of incandescent bulbs is clearly even more disadvantageous than the use of LEDs because they are more fragile, occupy a bigger volume, and use more power. Even designs which contemplate the use of EL strips or panels, encased in a transparent envelope, are inadequate for use in protective headwear, due to manufacturing or assembly difficulties and inadequate protection of the EL device itself from such environmental hazards as ultraviolet (UV) radiation and humidity.

SUMMARY OF THE INVENTION

It is accordingly an objective of the invention to provide a protective headwear which includes illumination but which does not possess the disadvantages of prior incandescent bulb, LED, and EL lighting arrangements.

It is also an objective of the invention to provide an illumination arrangement for protective headwear which is super-thin, multi-colored, has a wide viewing area and low power consumption, and yet is easy to assemble to protective headwear such as a helmet or hardhat and does not suffer the disadvantages of degradation due to exposure to UV radiation and humidity to which prior super-thin lighting arrangements for headwear of the type discussed above, involving placement of the lighting element in a transparent envelope, are subject.

While there are a number of unique aspects to the present invention, as will become apparent from the following description of preferred embodiments of the invention and the accompanying drawings, each of the embodiments has in common that the lighting element is a super-thin lighting element, defined as a lighting element having a thickness on the order of ten millimeters or less, and that the super-thin lighting element is affixed to the inner surface of the hard outer layer of the protective headwear, so as to be visible through the outer surface. As a result, the lighting element is protected at least by the outer layer, and in the case of protective headwear having additional layers, the lighting element may be further protected by the additional layers without complicating the assembly process by which the layers are added to the headwear. Generally, the outer protective layer of protective headwear of the type to which the invention is applicable is made of a plastic material, and thus portions of the plastic material can be made transparent without affecting the integrity of the outer layer, although it is within the scope of the invention to provide "windows" in the outer layer which provide less protection, or even are open. In any case, the result is a protective headwear lighting arrangement which is easily manufactured, does not compromise safety, and yet is durable and not subject to environmental degradation, unlike any of the arrangements described in the prior art.

The objectives of the invention are thus achieved using an essentially conventional protective headwear structure made up of a rigid exterior layer, an optional impact absorption layer, an optional second rigid layer, a soft inner layer, a strap or other fitting means, and optional sound and ventilation openings, to which are added a super-thin lighting element. If the lighting element is an electro-luminescent strip or panel, or other electrically activating lighting element, the protective headwear of the preferred embodiments will also include control circuitry, a power source, and means for attaching the circuitry and power source to the headwear, but if the super-thin lighting element is a photo-luminescent element, no additional circuitry will be needed.

In general, there are three principal types of headwear, and the present invention is especially suited to all three types.

The first of the three principal types of protective headwear to which the invention is applicable is one designed for maximum protection in the case of high speed impacts, and includes the hard outer layer, an absorption layer, and a second hard layer inside the absorption layer. The absorption layer is typically formed by filling the space between the rigid inner and outer layers with polyurethane foam of open or closed cell type. This type of helmet is principally used by motorcyclists, bicyclists, aircraft pilots, race car driver, and users of other motorized or high speed vehicles.

The second of the three types of protective headwear includes the hard outer layer and the absorption layer, but not the hard inner layer. Typically, in this second type of helmet, the absorption layer is preformed. The two layer helmet is lighter than the three protective layer helmet and is mainly used by roller skaters, recreational cyclists, skate boarders, and for water activities.

The third of the three types of protective headwear generally consists only of the outer layer, but with a thicker construction than the other two types of protective headwear. Typically, the hard outer layer of this type of helmet is formed by injection molding and includes some type of reinforcement, the helmet mainly being used as a hard hat by construction workers, firemen, miners, and other workers at sites where the principal danger is from falling objects rather than vehicle accidents.

In addition to the above-mentioned protective layers, each of the three principal types of protective headwear typically includes some type of soft textile or sponge material intended to provide comfort for the wearer by cushioning the load provided by the heavier, more rigid protection layers, and some type of fitting arrangement such as a strap. Also, protective headwear of all three types may optionally include ventilation or sound opening designed to permit air circulation and/or allow sound to reach the ears of the wearer.

As indicated above, the common feature of all of the types of protective headwear to which the invention is applicable is the hard outer layer. In all cases, the lighting arrangement is preferably installed at least partially inside the outer layer, so as to provide the following advantages:

1. The hard outer protects the super-thin light means from being scratched, peeled off, or otherwise physically damaged. Because the type of lighting elements used by the present invention are soft, and do not require any inwardly projecting terminals, the presence of the lighting elements inside the protective headwear does not pose a danger to the wearer of the headwear, even in the case of a severe impact.

2. Placement of the lighting element inside the hard outer layer and between the absorption layer and the outer layer also protects the lighting element from environmental damage due to moisture or humidity and, if the transparent or translucent portion of the outer layer through which the lighting element is to be viewed is constructed of an appropriate material, shields the lighting element from ultraviolet light.

3. The design of the lighting arrangement can easily be varied in an especially low cost manner to provide a variety of artistic, informational, and/or warning effects by masking either the transparent or translucent layer, or the lighting element itself, in some fashion, such as by silkscreening or painting opaque designs onto the window or lighting element in the form of logos, messages, characters. In addition, if the lighting element is in the form of EL panels, various special effects can easily be obtained by appropriate control of the trigger circuitry, without the need for complicated wiring arrangements or a relatively large printed circuit board for supporting the elements as would be the case if the lighting elements were in the form of LEDs, which do not at present qualify as super-thin lighting elements under the above definition.

4. Not only can the lighting arrangement of the present invention convey a variety of messages, but it can also provide, due to the ease by which area wide coverage is achieved, a nightlight for reading or other nighttime activities. The light can easily be applied to any curved surface of the helmet, and thus can be placed where the lighting is most needed.

5. Finally, as suggested above, because the lighting arrangement of the present invention is affixed to the inside of the outer layer, it can easily be used in a variety of protective headwear constructions, including those with different numbers of layers, by applying such simple techniques as taping, gluing, Velcro™, solvents, hot welding, and so forth, to any desired portion of the hard outer layer.

BRIEF DESCRIPTION OF THE DRAWINGS

FIG. 4A is a perspective view showing a variation of the helmet shown in 4.

FIG. 4B is a perspective view showing a further variation of the helmet shown in FIGS. 4.

FIGS. 9A–9D are perspective views of alternative types of helmets constructed according to the principles of the preferred embodiment of the invention.

DETAILED DESCRIPTION OF THE PREFERRED EMBODIMENTS

Figure 1:
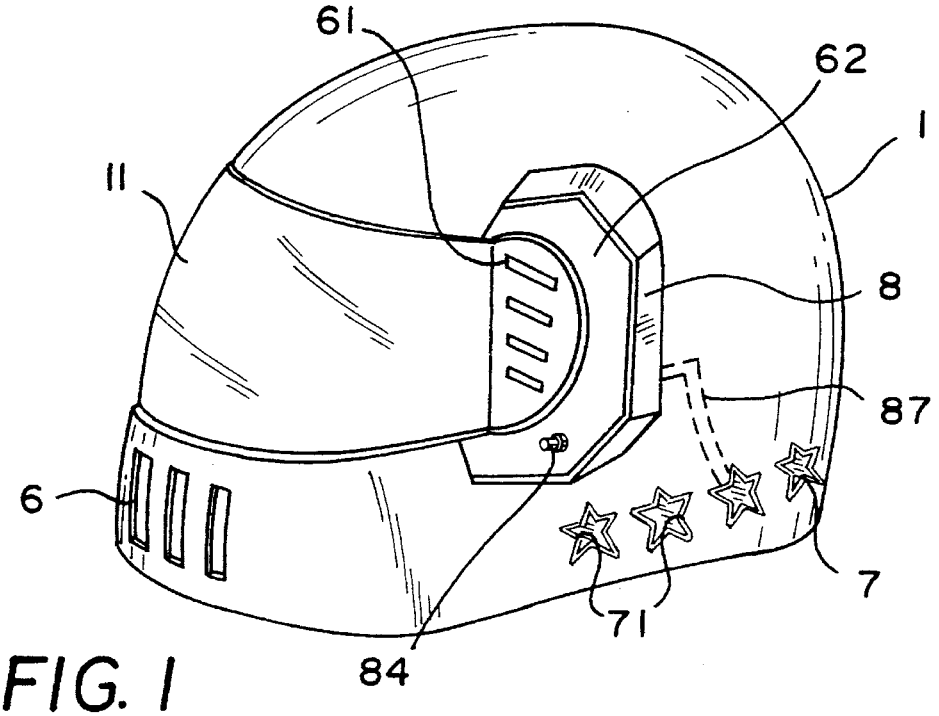
FIG. 1 is a perspective view of an illuminated helmet constructed in accordance with the principles of a preferred embodiment of the invention.
Figure 2:
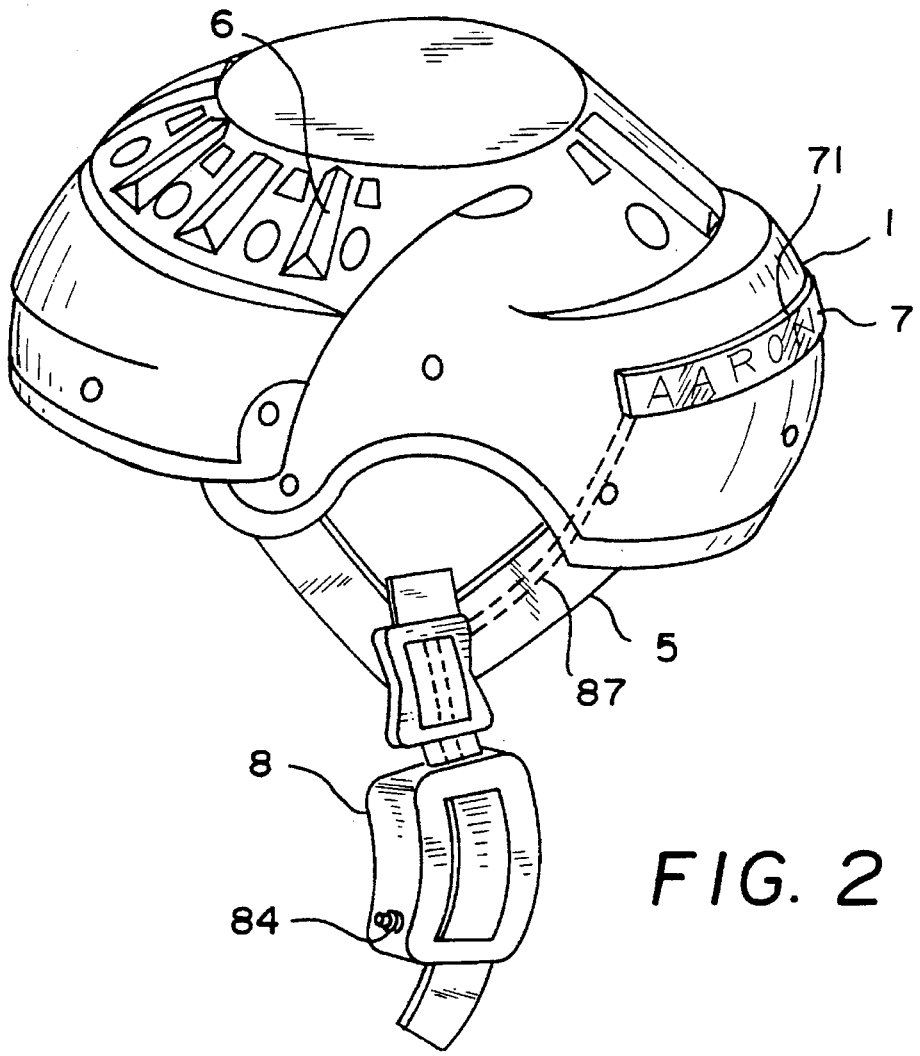
FIG. 2 is a perspective view of a variation of the illuminated helmet of FIG. 1, constructed in accordance with the principles of a second preferred embodiment of the invention.
Figure 3:
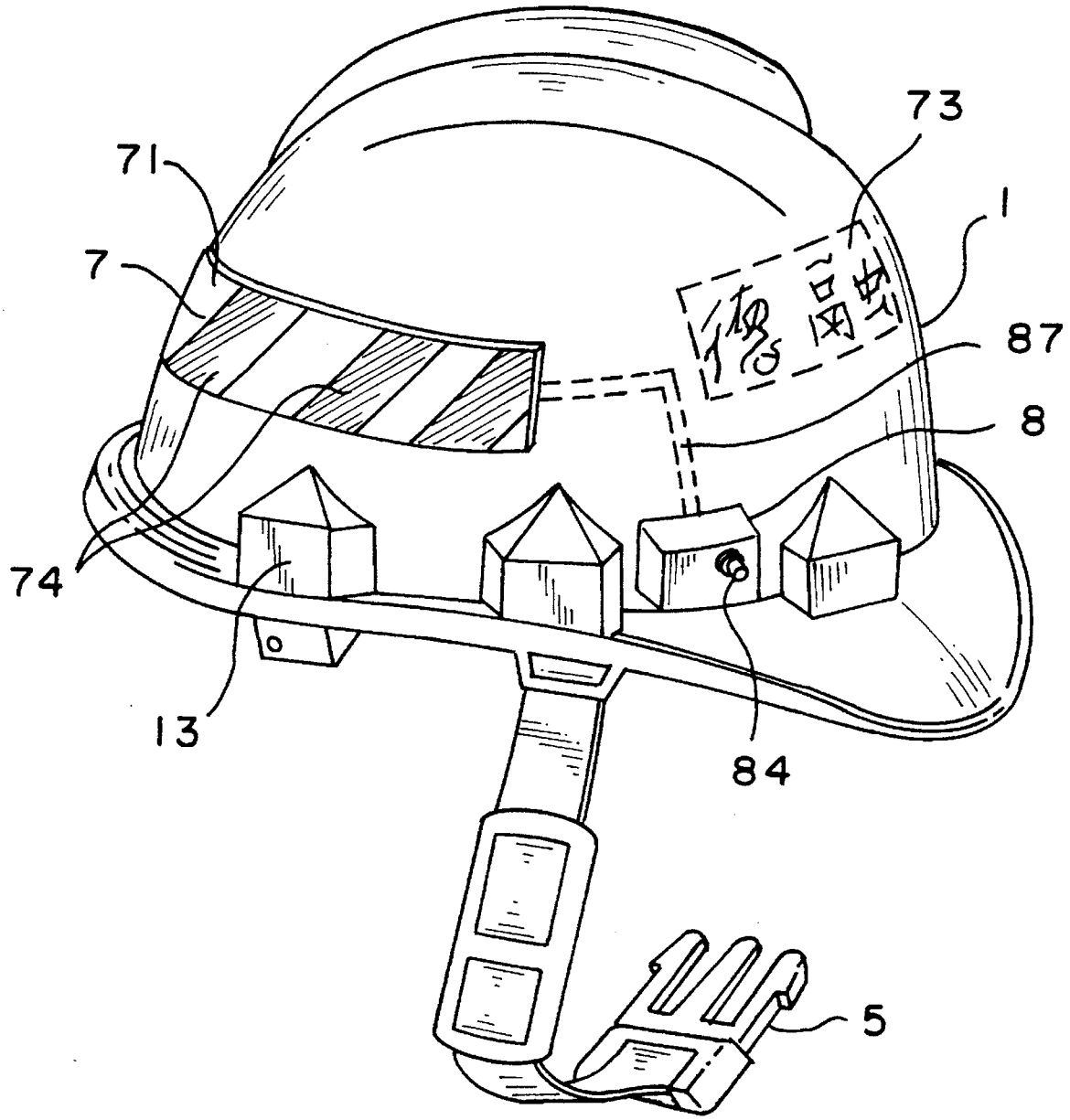
FIG. 3 is a perspective view of an illuminated hard hat constructed in accordance with the principles of a third preferred embodiment of the invention.

FIGS. 1–3 generally illustrate applications of the invention to various different types of protective headwear.

The first illustrated application is to a motorcycle helmet, which conventionally is made up of a hard outer layer 1, and a hard inner layer (not shown) and absorption layer (also not shown) of the type described above. Details of the three layer construction are further illustrated, in connection with a slightly different type of helmet, in FIGS. 4–4B. The motorcycle helmet of this embodiment of the invention also includes a visor 11, ventilation openings 6, and sound openings 61 in a recessed area 62 which supports a visor bracket at the side of the visor.

Figure 4:
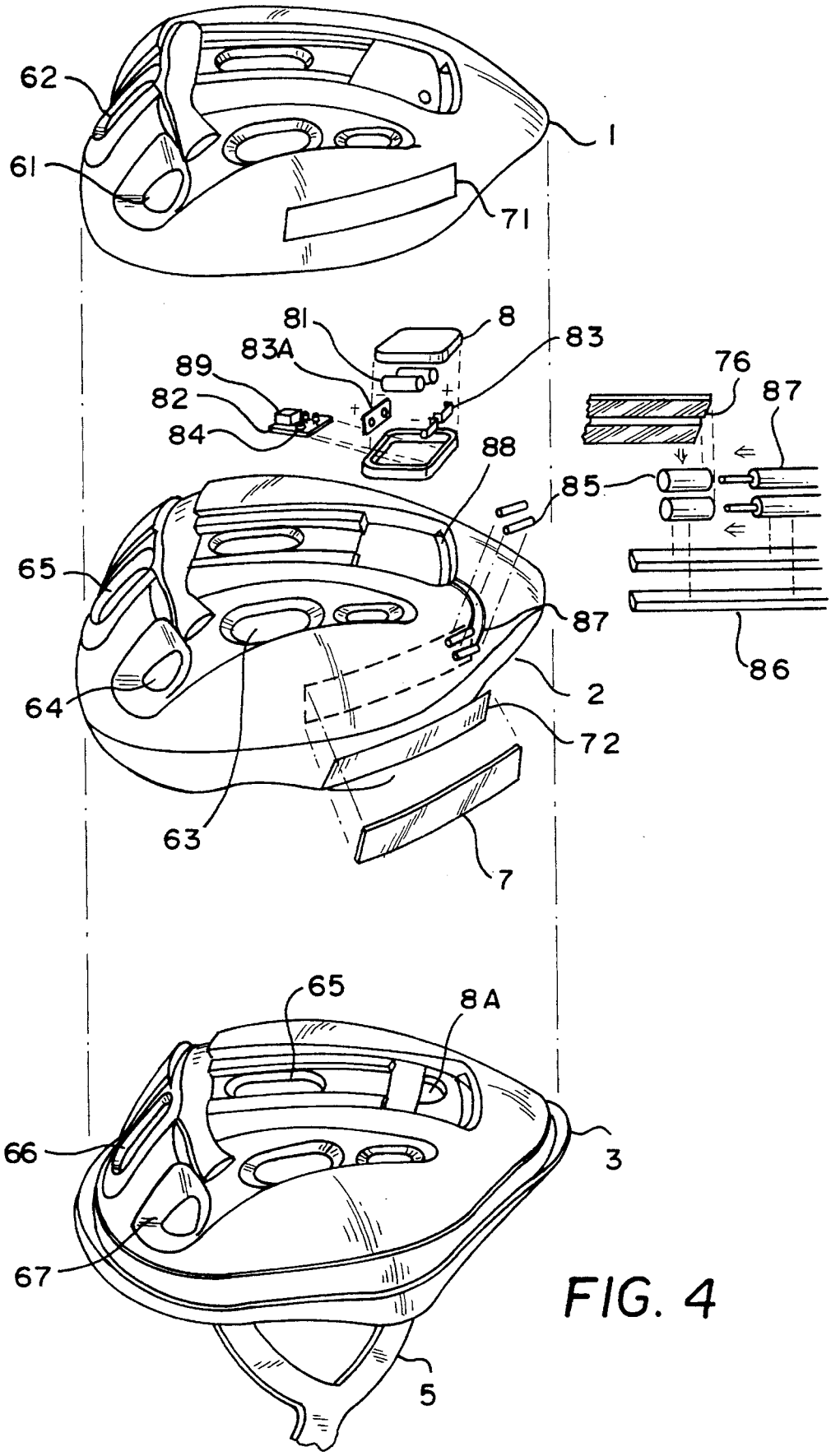
FIG. 4 is an exploded perspective view of a three layer helmet similar in construction to the helmet of FIG. 1.

Rather than placing the lighting element on the surface of the helmet, in a complicated and dangerous construction, the outer layer of the motorcycle helmet shown in FIG. 1 includes a plurality of openings or windows 71 behind which are positioned one or more super-thin lighting elements 7 so as to be visible through the openings or windows in a manner which may be better understood in connection with the description of FIG. 4. The lighting elements are connected, if necessary, by a wire harness 87 to a power supply and circuitry positioned in the area of the sound openings 61 since the absorption and inner layers have also been removed from this area to permit passage of sound to the wearer's ear. A switch 84 projects from the outer layer of the helmet into recessed visor bracket/sound opening area 62 to permit the wearer to switch the lighting on and off. Preferably, in order to ensure maximum structural integrity of the helmet, the windows are in the form of a transparent or translucent plastic molded into the outer layer 1.

By adhering the lighting elements 7 to the outer layer by 1 any of the above-mentioned attachment means, i.e., by glue, hot-welding, solvent, Velcro™, melting, and so forth, and by pre-wiring the helmet before the absorption layer is added, for example by filling the space between the hard inner and outer layers, the lighting elements and wiring will become sealed within the helmet, thereby protecting them from environmental influences such as pollutants and moisture. Furthermore, the window through which the lighting elements are visible can easily be made of a UV shielding material so as to protect the lighting elements from degradation due to UV radiation.

FIG. 2 shows a helmet of lighter construction than the motor cycle helmet, in which the hard inner layer is usually dispensed with by pre-forming the absorption layer not shown). In this helmet, which does not cover the face of the wearer, and which is designed for outdoor activities such as skating or skateboarding, the window in the hard outer layer 1 through which the lighting element 7 is viewed is an opening, and the wiring harness 87 follows a strap 5 for securing the helmet to the wearer, with the power pack and control circuitry housing 8 being attached to the strap, with a switch 84 again exposed so as to permit the lighting element to be turned on and off. Those skilled in the art will appreciate, however, that if the lighting element is a photoluminescent element, made of a powder which is self illuminating, the wiring harness and power pack are not necessary.

The embodiment shown in FIG. 3 is a protective headwear device of the third type discussed above, commonly known as a hard hat, in which protection is provided by a single hard outer layer. The hard hat includes a plurality of reinforcing ribs 13 and includes an opening or window 71 which permits passage of light through the outer layer. Because the principal danger when this type of protective headwear is worn comes from falling objects, the housing 8 for the power pack, control circuitry, wiring harness 87 and switch 84 may be installed either inside or outside the hard outer layer 1.

In the embodiment shown in FIG. 3, it is especially advantageous to include lighting designs which provide traffic or roadside safety signals for workers. This can easily be done by silkscreening or otherwise decorating the lighting element or the window through which it is viewed, as exemplified by stripes 074 shown in FIG. 3. In addition, a lighting element 73 on which is printed a logo may be added anywhere on the interior or exterior surface of the hard hat. Finally, the protective headwear of this embodiment can further include an absorption layer in the form of a sponge or textile-band support (not shown), and a fitting means or strap 5 which generally includes a strip of Velcro™, tape, belts, buckles, fasteners, and clips or buckles to position the helmet on the wearer and to allow the wearer to easily remove the helmet when needed.

FIG. 4 shows details of a protective headwear embodiment similar to the one shown in FIG. 2, except that for illustrative purposes this helmet includes all three of the possible protection layers, namely both outer and inner hard layers 1 and 3, respectively, as well as an absorption layer 2 which may either be pre-formed or formed by injecting a foam material between layers 1 and 3.

In this embodiment, the window or opening 71 which permits passage of light through outer layer 1 is in the form of a completely or partially transparent portion of the hard outer layer, which also includes openings 61 and 62 for permitting sound to enter the helmet and provide ventilation, the openings communicating with corresponding openings 64–67 in the respective absorption and inner layers 2 and 3.

It will be appreciated by those skilled in the art that the hard outer layer 1 may be made, as is conventional, of a high impact plastic material formed either by sheeting or injection molding to have a shape designed to distribute or deflect the force of impacts. This layer reduces the strength of an impact at any point so that the force on any point in an inner layer is reduced. However, in certain areas of the helmet, openings may be made without significantly affecting the level of protection provided, particularly since the force of impacts to the outer layer is absorbed by the absorption layer after being deflected or distributed by the outer layer, with even further force distribution being provided by the hard inner layer.

The absorption layer 2 is conventionally formed from a polyfoam or polyurethane material to isolate the inner layer from the outside layer using a honeycomb, cellular, or bubble type construction, while the hard inner layer conventionally uses a material similar to that of the hard outside layer 1 to further distribute impacts and form a container of the absorption layer. Whether the absorption layer 2 is pre-formed or injected into the space between layers 1 and 3, it serves not only to cushion impacts but also to protect the lighting element which has been pre-attached to the outer layer 1, preferably by glue, tape, Velcro™, welding and so forth. In the case of formation of absorption layer 2 by injection, those skilled in the art will appreciate that it is important that the lighting element be tightly fitted against the inside surface of outer layer 71, and perhaps be covered by a piece of tape 72, to prevent the injected foam from penetrating into the space between the hard outer layer and the lighting element and thereby obscuring the view through window 71.

In the case where the lighting element 7 is an EL strip, the lighting element is preferably connected to the control circuit 8 by two wires of harness 87. In a particularly advantageous embodiment of the invention, the wires are situated in holders 86 and connected to surfaces 76 of an El strip of the type disclosed in copending U.S. patent application Ser. No. 08/383,404, filed Feb. 3, 1995, by means of conductive rubber poles 85, the conductive rubber poles being fitted over exposed ends of the wires 87 and arranged such that when the polyurethane absorption layer 2 is positioned relative to the hardshell layer 1, the absorption layer presses the conductive rubber poles against the exposed ends of the wires over which they have been fitted and against the electrodes on the lighting element and thereby ensure a good electrical connection. The wires are then connected between the lighting element and the wires via the conductive rubber poles to circuitry provided in power pack 8 which contains, mounted on a printed circuit board 82, a plurality of electrical components including a transistor, resistor, capacitor, diode, transformer 89, and on/off switch 84, as well as battery terminals 83 and 83A, and battery 81, all for the purpose of supplying DC power and converting the DC power to a current having a voltage and frequency sufficient to trigger the material of the lighting element to turn on.

Preferably, the positioning of the circuit and power pack 8 relative to the three protective layers is such that switch 84 extends through an opening 8A in inner layer 3 to provide access for turning the lighting element on and off, and such that a battery compartment closure of the power pack is positioned relative to an opening 8A in the inner layer 3 so as to permit replacement of batteries by the user. Alternatively, as shown in FIG. 4A, the opening 8A may be provided in the outer layer 1 of the helmet.

In addition to providing a window 71 at the front of the helmet, windows may also be provided at the side, or anywhere else, on the helmet as shown in FIG. 4B, which illustrates the example of five circular windows 71, each of which has a separate lighting element 7 secured thereto by tape 72.

Finally, to complete the helmet of this embodiment of the invention, a soft inner layer made of a textile or sponge material, and an adjustment strap 5, may be provided to cushion the hard inner layer for the comfort of the wearer during normal use.

Figure 5:
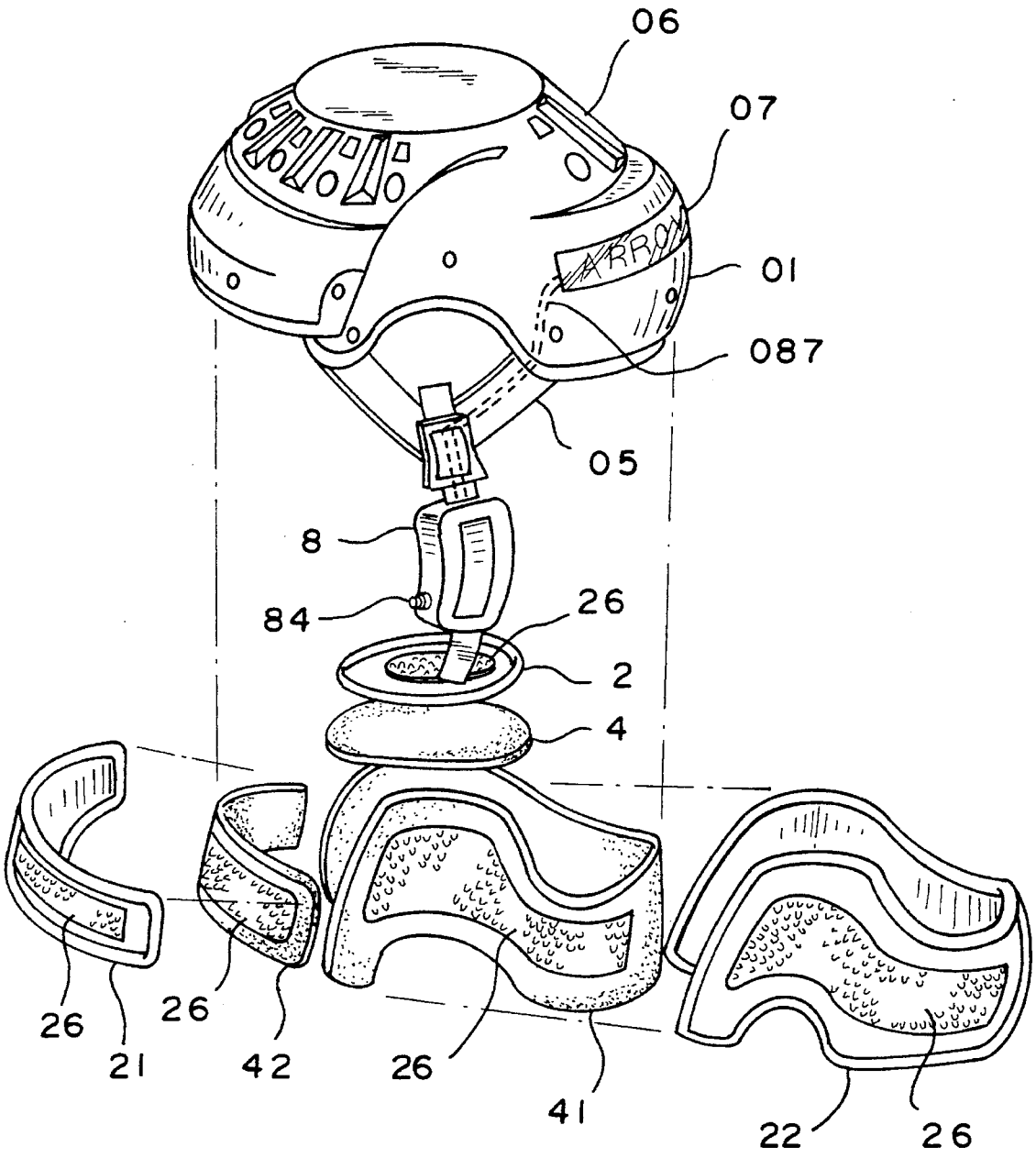
FIG. 5 is a combined perspective and partially exploded view showing the construction of the helmet of FIG. 2.

FIG. 5 shows in greater detail portions of the two layer helmet illustrated in FIG. 2, which is designed for non-motor use and therefore does not require the hard inner layer, the absorption layer being preformed. As indicated above, in this embodiment, the super thin lighting element 7 is again well attached between the hard outer layer 1 and absorption layers 2, 21, and 22, but the circuit and its power pack 8 are arranged on a strap and buckle device 5 by, for example, a traditional stitching method, rather than between the outer and inner layers as in the three layer version, and the pre-formed absorption layers 2, 21, and 22 are adhered to the outer layer by, for example, Velcro™, soft textile or sponge layers 4, 41, and 42 in turn being secured to the absorption layers, also by an attachment means such as Velcro™.

Figure 6:
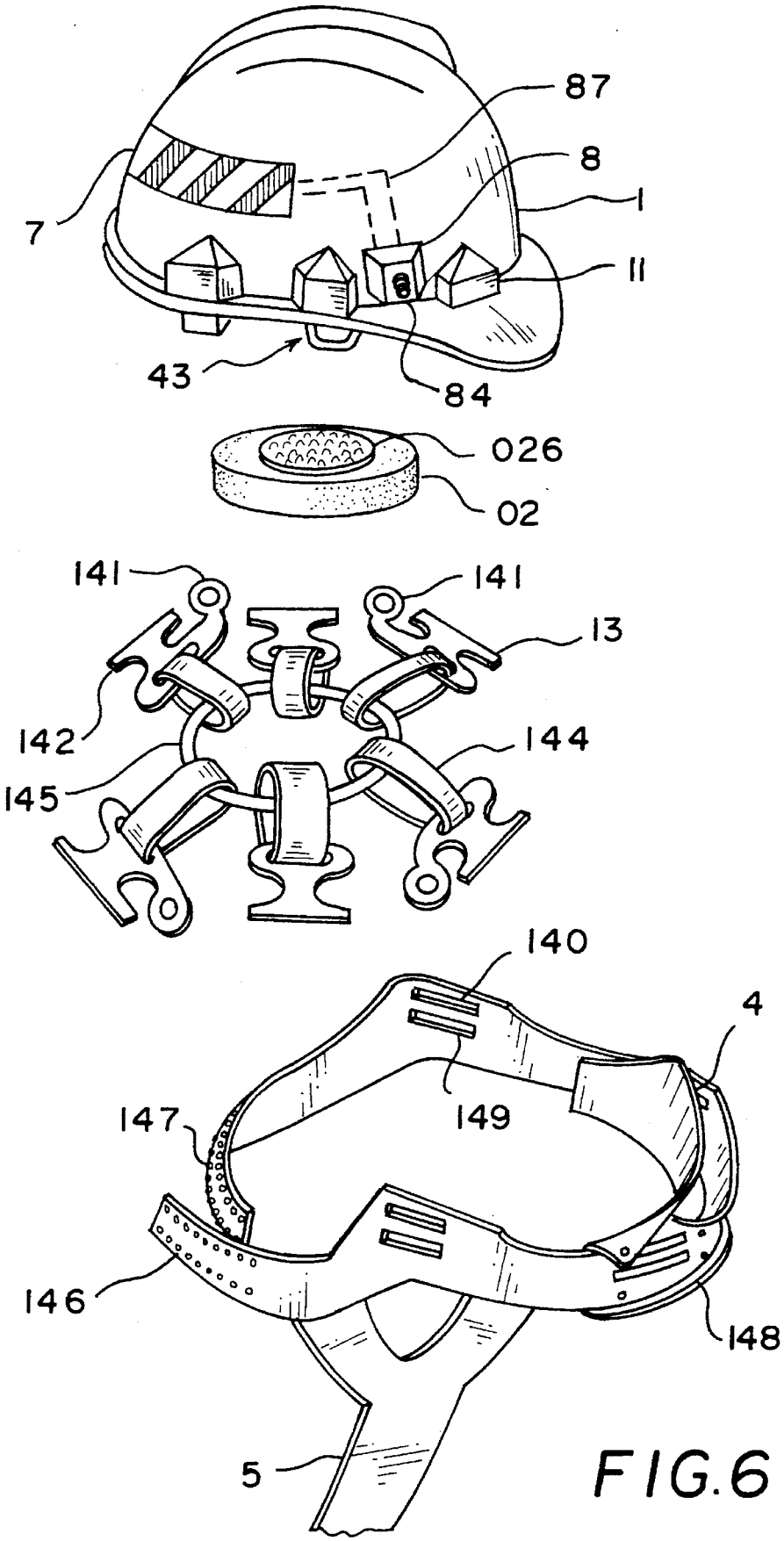
FIG. 6 is an exploded perspective view of the hard hat of FIG. 3.

Details of hard hat illustrated in FIG. 3, in which the only protective layer is in general the hard outer layer, are shown in FIG. 6. However, although construction of the hard hat and placement of the lighting element 7 and power pack/control circuitry housing 8 is substantially identical to that shown in FIG. 3, it will be appreciated by those skilled in the art that an absorption layer 2 could in fact be added if desired even to this type of headwear, as indicated in phantom in FIG. 6, the absorption layer being attached to the top inside surface of the hard outer layer 1 by an attachment means 26.

Although a hard inner layer of the type used in the helmets of FIGS. 1 and 4 is not included in this helmet, a rigid force distributing member 13 made up of a ring to which are connected attachment members 13 via strips 144. Attachment members 13 include slide lock arms 142 for cooperation with slots 43 provided in the hard exterior layer and locking members 141 which are secured to slots 140 and 149 in soft material layer 4 supported by head-frame 148. Head-frame 148 can be adjusted by means of cooperating Velcro™ strips 147 and 148, completing the hard hat of this embodiment of the invention.

Figure 7:
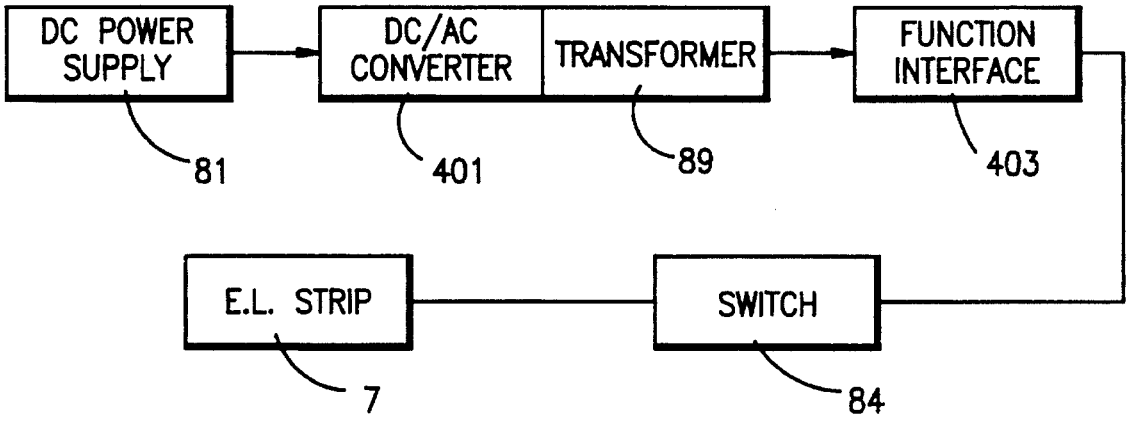
FIG. 7 is a block diagram of electrical components which may be used in the implementations of the preferred embodiment illustrated in FIGS. 1–3.
Figure 8:
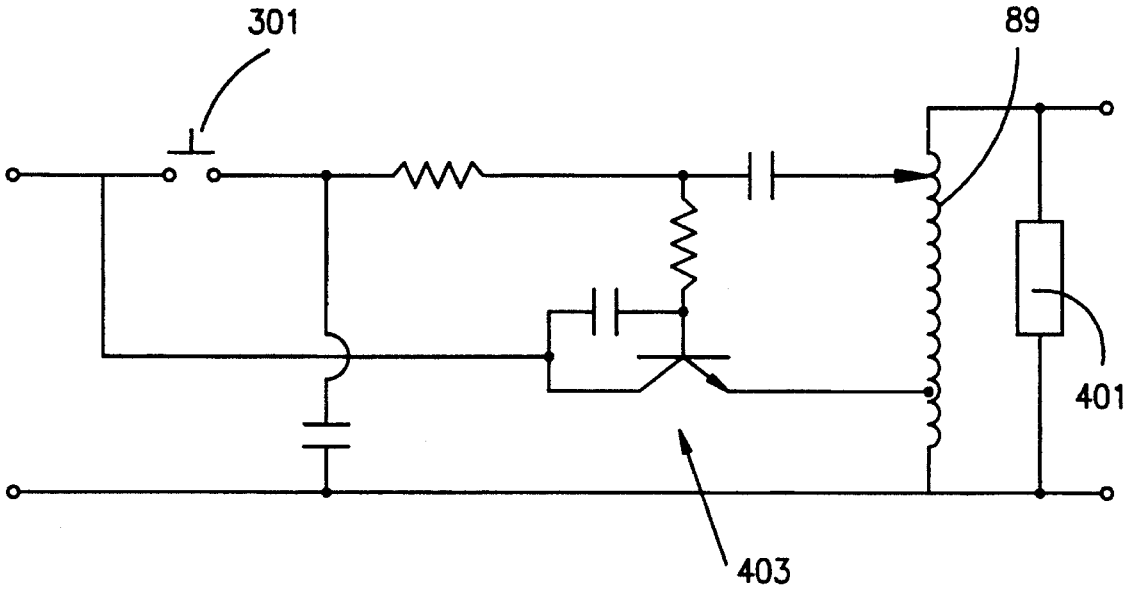
FIG. 8 is a circuit diagram illustrating in greater detail the electrical circuitry used in the block diagram of FIG. 7.

Turning now to FIGS. 7 and 8, which show details of the electrical components and circuitry used in the case where the lighting element is an EL strip or panel 7 powered by a DC power supply. The EL strip or panel 7 can be in the form of a sheet, strip, tube, or other shape depending on the design requirements and on the shape of the helmet or hard hat to which it is applied, but an especially suitable type of EL strip is a strip of the type disclosed in copending U.S. patent application Ser. No. 08/383,404, filed on Feb. 3, 1995.

Preferably, as shown in FIGS. 7 and 8, the DC power supply 303 for the EL strip or panel 7 is a dry cell battery. However, in order to operate the EL strip or panel, the DC current supplied by the battery must be converted to AC power and, consequently, as shown in FIGS. 7 and 8, the DC power source 303 is electrically connected to the electro-luminescent light strip 7 via a circuit including a DC/AC converter 401 electrically connected with a transformer 402, transformer 402 being further electrically connected with a function interface 403 and, via parallel connected switch 84, with the EL strip 7. Those skilled in the art will appreciate that the battery in this embodiment of the invention can be a rechargeable battery which can be charged by a device having a higher voltage output than the battery's.

In operation, the direct current supplied by DC power source 303 is thus converted into an alternating current of a desired frequency by DC/AC converter 401 to the transformer 402 for increasing the voltage of the alternating current, and then transmitted from the transformer 402 to the function interface 403. Function interface 403 provides a number of preset or switchable options for turning on the EL light strip 7, e.g., steady, flash, sequential or random, and may take any desired form from a simple flasher circuit illustrated in FIG. 5 to a microprocessor, depending on the complexity of the special effects to be exhibited. Those skilled in the art will appreciate that the number of options is greatly increased if a multiple element strip such as the one disclosed in copending U.S. patent application Ser. No. 08/305,294 is utilized. Also, while the EL light strip can be turned on and off by means of a manual push button switch 84, it may also be desired to include or substitute a photo-sensitive, vibration-sensitive, tilt-sensitive, or motion-sensitive switch to automatically turn the light on and off upon the occurrence of external events such as nightfall or various movements by the wearer.

Having thus described several preferred embodiments of the invention and a number of variations and modifications of the preferred embodiments, it is anticipated that still further variations and modifications will undoubtedly occur to those skilled in the art upon reading the above description, for example upon applying the principles of the invention to other types of helmet such as the hockey helmets shown in FIGS. 9A and 9B, or the skating helmets shown in FIGS. 9C and 9D, and it is therefore intended that the invention be interpreted, in accordance with the appended claims, to cover all such variations and modifications which fairly fall within the scope of the invention.

I claim:

1. In protective headwear of the type comprising a hard outer layer, the improvement wherein the hard outer layer includes an at least partially transparent area and wherein a flexible lighting element is affixed to an inside surface of the hard outer layer and visible through said at least partially transparent area of the hard outer layer and further comprising an inner layer positioned inside the hard outer layer, wherein said inner layer is an absorption layer made of a foam material adhered to said hard outer layer to form a seal about said lighting element.

2. Protective headwear as claimed in claim 1, further comprising an additional hard inner layer, and wherein the absorption layer is formed by filling a space between the hard outer layer and the hard inner layer with said foam material.

3. Protective headwear as claimed in claim 1, wherein the absorption layer is a pre-formed layer.

4. Protective headwear as claimed in claim 2, wherein the lighting element is an electro-luminescent lighting element, and further comprising a wiring harness for connecting the lighting element to circuitry in a power pack, said power pack also containing a DC power source and a housing.

5. Protective headwear as claimed in claim 4, wherein the power pack is exposed for access to a switch and for replacement of the DC power source, and wherein both the lighting element and power pack are otherwise enclosed by an absorption layer.

6. Protective headwear as claimed in claim 4, wherein the power pack is attached to a helmet adjustment strap.

7. Protective headwear as claimed in claim 4, further comprising additional lighting elements whose on/of times are controlled by said circuitry to achieve motion effects by activating the lighting elements at different times.

8. Protective headwear as claimed in claim 4, wherein the electro-luminescent lighting element is connected to the circuitry by means of conductive rubber poles which are pressed against the electro-luminescent panel by said absorption layer to effect the electrical connection.

9. Protective headwear as claimed in claim 2, wherein the lighting element has a thickness of less than 3 mm.

10. Protective headwear as claimed in claim 2, wherein the lighting element has a thickness of approximately 1 mm.

11. Protective headwear as claimed in claim 2, wherein the lighting element includes a decorative or informative design.

12. Protective headwear as claimed in claim 11, wherein the design is selected from the group consisting of stencilled designs, designs created by silkscreening, designs created by adding an opaque layer to the lighting element, and designs resulting form an arrangement of an electro-luminescent and/or photoluminescent material within the lighting element.

13. Protective headwear as claimed in claim 2, wherein the lighting element is installed at a front side of the protective headwear for use as a reading lamp.

14. In protective headwear of the type comprising a hard outer layer, the improvement wherein the hard outer layer includes a plurality of at least partially transparent areas and a plurality of lighting elements affixed to an inside surface of the hard outer layer and visible through said at least partially transparent areas of the hard outer layer, wherein the outer layer is pre-wired to electrically connect the lighting elements to a power pack, and wherein the outer layer is filled with an inner absorption layer made of a foam material adhered to said hard outer layer to form a seal about the lighting elements and wiring within the helmet.

15. Protective headwear as claimed in claim 14, further comprising a hard inner layer, said pre-wiring being situated in a space between the hard inner and outer layers, and wherein the space between the hard inner and outer layers is filled by said absorption layer to thereby seal the lighting elements and wiring into the helmet.

16. Protective headwear as claimed in claim 14, further comprising a power source, control circuitry including a function interface, and means for attaching the circuitry and power source to the headwear, wherein the power source and control circuitry are arranged in a power pack and connected to the lighting elements by wiring, and wherein the function interface forms a means for variably activating the lighting elements to achieve motion effects.

17. Protective headwear as claimed in claim 16, wherein the lighting elements are electro-luminescent lighting elements and the lighting arrangement formed by the lighting elements is multi-colored.

18. Protective headwear as claimed in claim 14, wherein the lighting arrangement formed by the lighting elements includes designs formed by masking.

19. Protective headwear as claimed in claim 18, wherein the designs are formed by silk-screening.

20. Protective headwear as claimed in claim 18, wherein the designs are formed on the transparent areas of the hard outer layer.

21. Protective headwear as claimed in claim 18, wherein the designs are formed on the lighting elements.

* * * * *